United States Patent [19]

Tanaka et al.

[11] Patent Number: 4,886,306

[45] Date of Patent: Dec. 12, 1989

[54] STARTER

[75] Inventors: Toshinori Tanaka; Shuzoo Isozumi; Keiichi Konishi, all of Hyogo, Japan

[73] Assignee: Mitsubishi Denki Kabushiki Kaisha, Tokyo, Japan

[21] Appl. No.: 265,379

[22] Filed: Oct. 31, 1988

[30] Foreign Application Priority Data

| | | | |
|---|---|---|---|
| Oct. 2, 1987 | [JP] | Japan | 62-168224 |
| Nov. 6, 1987 | [JP] | Japan | 62-170613 |
| Feb. 12, 1988 | [JP] | Japan | 63-31188 |

[51] Int. Cl.[4] ..... F02N 11/00

[52] U.S. Cl. ..... 290/48; 74/7 R

[58] Field of Search ..... 290/38 R, 48; 74/7 R, 74/7 A, 7 B; 123/179 R, 179 M

[56] References Cited

U.S. PATENT DOCUMENTS

| | | | |
|---|---|---|---|
| 3,791,685 | 2/1974 | Hamman | 290/48 X |
| 4,326,429 | 4/1982 | Mortensen | 74/7 R |
| 4,404,533 | 9/1983 | Kurihara et al. | 335/131 |
| 4,604,907 | 8/1986 | Horishita et al. | 74/7 A X |
| 4,613,761 | 9/1986 | Yabunaka | 290/36 R |

FOREIGN PATENT DOCUMENTS

| | | |
|---|---|---|
| 59-141768 | 8/1984 | Japan . |
| 61-1864 | 7/1986 | Japan . |
| 927133 | 5/1963 | United Kingdom . |

*Primary Examiner*—William M. Shoop, Jr.
*Assistant Examiner*—W. E. Duncanson, Jr.
*Attorney, Agent, or Firm*—Sughrue, Mion, Zinn, Macpeak & Seas

[57] ABSTRACT

A starter includes a movable pinion cylinder mounted on a rotary output shaft so that the movable pinion cylinder is slidable on the rotary output shaft a by predetermined distance together with an overrunning clutch. The movable pinion cylinder has the front end portion formed into a pinion which is engaged with an engine ring gear, and the rear end portion formed into a clutch inner forming a part of the overrunning clutch. The starter further includes a cylindrical cap connected to the front end of the rotary output shaft to cover the front end portion of the rotary output shaft, a protrusion extended from the center of the end face of the cap toward the end face of the rotary output shaft, the protrusion having an air hole extended along the axial line thereof, and a hole formed in the end face of the rotary output shaft at the center to receive the protrusion.

8 Claims, 5 Drawing Sheets

STARTER

BACKGROUND OF THE INVENTION 1. (Field of the Invention)

This invention relates to starters, and more particularly to an overhang type starter with a dust protective device adapted to start a vehicle engine.

2. (Prior Art)

In a conventional starter of this type, a movable pinion cylinder is designed as disclosed, for instance, by Japanese Utility Model Application (OPI) No. 6679/1986 (the term "OPI" as used herein means an "unexamined published application").

FIG. 1 shows a conventional starter 1, in which reference numeral 2 designates a front frame; 3, a rotary output shaft; and 4, an overrunning clutch whose clutch outer 4*a* is spline-engaged with the rotary output shaft 3 in such a manner that it is slidable on the rotary output shaft 3. Further, in FIG. 1, reference character 4*b* designates friction rollers; 5, a movable pinion cylinder mounted on the rotary output shaft 3, the movable pinion cylinder 5 having the rear end portion formed into a clutch inner 4*c;* 6, a ball bearing which supports the middle portion of the movable pinion cylinder 5 on the front frame 2; 7 and 8, sleeve bearings; 9, a stopper mounted on the front end portion of the rotary output shaft 3; 10, a pinion formed on the front end portion of the movable pinion cylinder 5; 11, an engine ring gear; and 12, a bottommed cylindrical cap connected to the front end of the movable pinion cylinder 5 so as to close the front end opening 5*a*. The cap is long enough to cover the front end portion of the rotary output shaft 3. The cap 12 has an annular protrusion 12*a* forming the edge of its opening, which is engaged with an annular groove 5*b* formed in the movable pinion cylinder 5; that is, the cap 12 is detachably connected to the front end of the movable pinion cylinder 5.

The cap 12 is provided to prevent the entrance of dust through the front end opening 5*a* of the movable pinion cylinder 5, and it is made of resin such as "Nylon".

However, the conventional starter described above suffers from the following difficulties:

Since the cap 12 is completely closed, when the movable pinion cylinder 5 is moved forwardly by the shift lever 13, the space in the cap 12 is increased. When the movable pinion cylinder 5 is returned to its original position as shown in FIG. 1, the front end portion of the rotary output shaft 3 is allowed to go in the cap 12, so that the space in the cap 12 is decreased. As the space in the cap 12 changes as described above, the air pressure in the cap is changed. That is, in moving the movable pinion cylinder 5 forwardly, the negative pressure formed in the cap 12 will obstruct the movement of the movable pinion cylinder 5; and in returning the movable pinion cylinder, the air pressure in the cap 12 is increased, so that the cap may be caused to come off or may be damaged.

SUMMARY OF THE INVENTION

An object of this invention is to eliminate the above-described difficulties accompanying a conventional starter. More specifically, an object of the invention is to provide a starter in which a dust protective cap connected to the front end of the movable pinion cylinder to cover the rotary output shaft will not adversely affect the sliding operation of the movable pinion cylinder.

The foregoing object of the invention has been achieved by the provision of a starter having a movable pinion cylinder mounted on a rotary output shaft in such a manner that the movable pinion cylinder is slidably on the rotary output shaft a predetermind distance together with an overrunning clutch, the movable pinion cylinder having the front end portion formed into a pinion which is engaged with an engine ring gear, and the rear end portion formed into a clutch inner forming a part of the overrunning clutch; which, according to the invention, further comprises: a bearing fitted in the cylindrical hole of the movable pinion cylinder; a cylindrical cap secured to the front end of the movable pinion cylinder; a circular-truncated-cone-shaped protrusion extended from the center of the end face of the cap towards the end face of the rotary output shaft, the protrusion having an air hole extended along the axial line thereof; and a hole formed in the end face of the rotary output shaft at the center to receive the protrusion.

Further, the foregoing object of this invention has been achieved by the provision of a starter of overhang type which comprises: an electric motor for providing torque to start an engine and a movable pinion cylinder slidably mounted on a rotary output shaft extended from the rotary shaft of the armature of the motor, the movable pinion cylinder having the front end portion formed into a pinion part, the rear end portion formed into the clutch inner part of an overrunning clutch device, and the middle portion formed into a slidably supporting surface which supports a bearing fitted in the front frame of the motor, the rotary output shaft being supported through the movable pinion cylinder by the front frame; in which, according to the invention, a bottomed cylindrical cap is connected to the front end of the movable pinion cylinder in such as manner as to cover the front end portion of the rotary output shaft, and a through-hole is formed in the rotary shaft of the armature and the rotary output shaft integral with the rotary shaft of the armature in such a manner that the through-hole is extended along the central axis of these shafts, and the inside of the cap is communicated through the through-hole with the outside air.

In the starter of the invention, when the movable pinion cylinder slids on the rotary output shaft, air is allowed to flow in or out of the cap through the air hole, and therefore the air pressure in the cap is maintained unchanged. The air hole is formed in the circular-truncated-cone-shaped protrusion extended from the end face (the bottom) of the cap, and when the movable pinion cylinder is at the non-operating position, the protrusion is held inserted into the hole formed in the end face of the rotary output shaft, and therefore the entrance of dust through the air hole can be prevented by the labyrinth effect.

Further, in the starter of the invention, when the movable pinion cylinder is moved forwardly, the space in the cap is abruptly increased, and therefore the pressure in the cap is going to decrease. However, since the air is sucked into the cap through the axial through-hole formed in the armature rotary shaft and the rotary output shaft integral with the armature rotary shaft from behind the motor, the pressure in the cap is not decreased, and therefore the movable pinion cylinder can move smoothly. In this case, the air behind the starting motor is sucked into the cap through the axial through-hole formed in the armature rotary shaft and the rotary output shaft integral with the armature rotary shaft, as was described above. The air thus sucked is relatively clean because of the positional relationship of the starting motor with the engine, and therefore no dust will go into the cap. When the movable pinion cylinder is moved back to the original position, the air in the cap is discharged through the axial through-hole, and therefore the pressure in the cap is not increased. Thus, the movable pinion cylinder can slide back to the original position.

DETAILED DESCRIPTION OF THE PREFERRED EMBODIMENTS

One preferred embodiment of this invention will be described with reference to the accompanying drawings.

Figure 1:
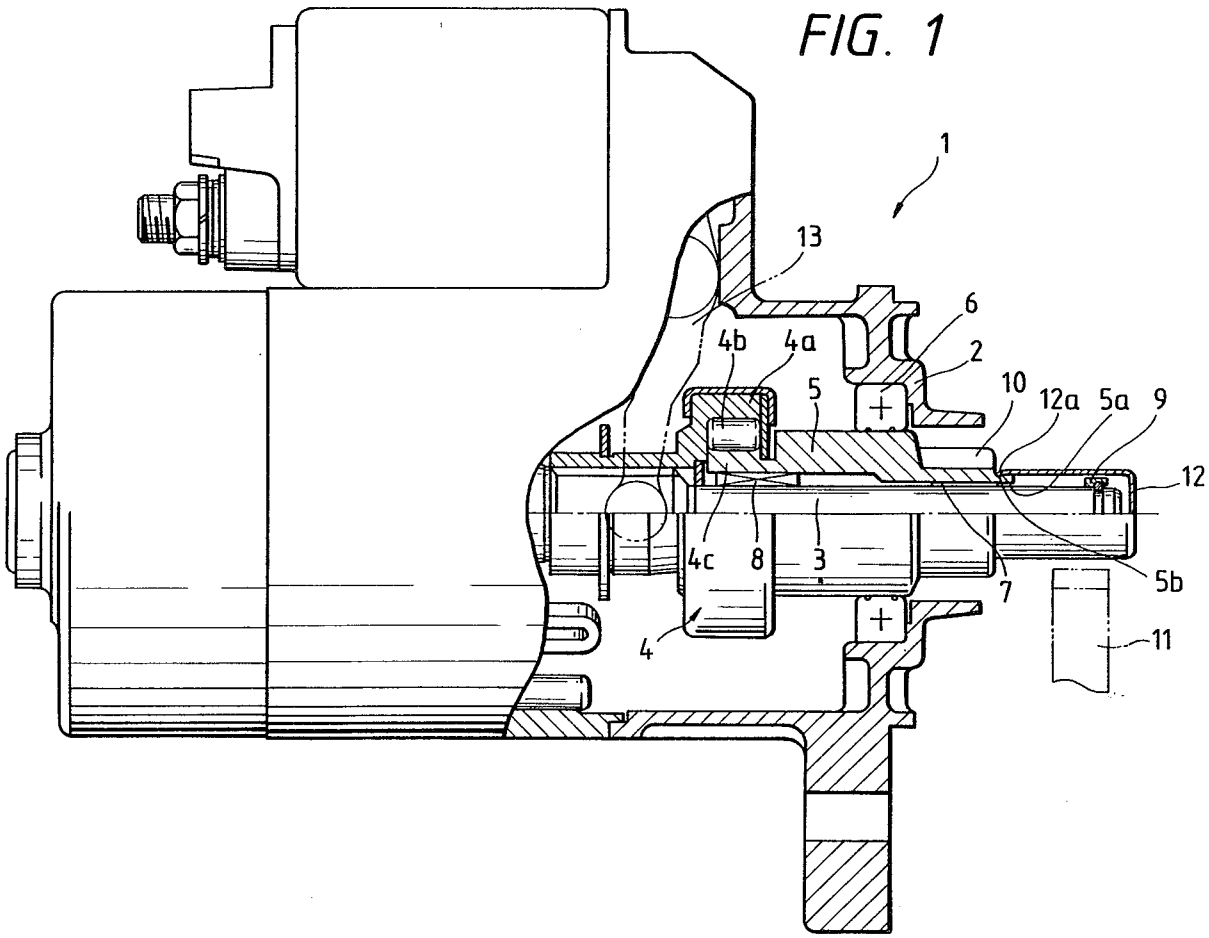
FIG. 1 is a front view, with part cut away, showing a conventional starter.
Figure 2:
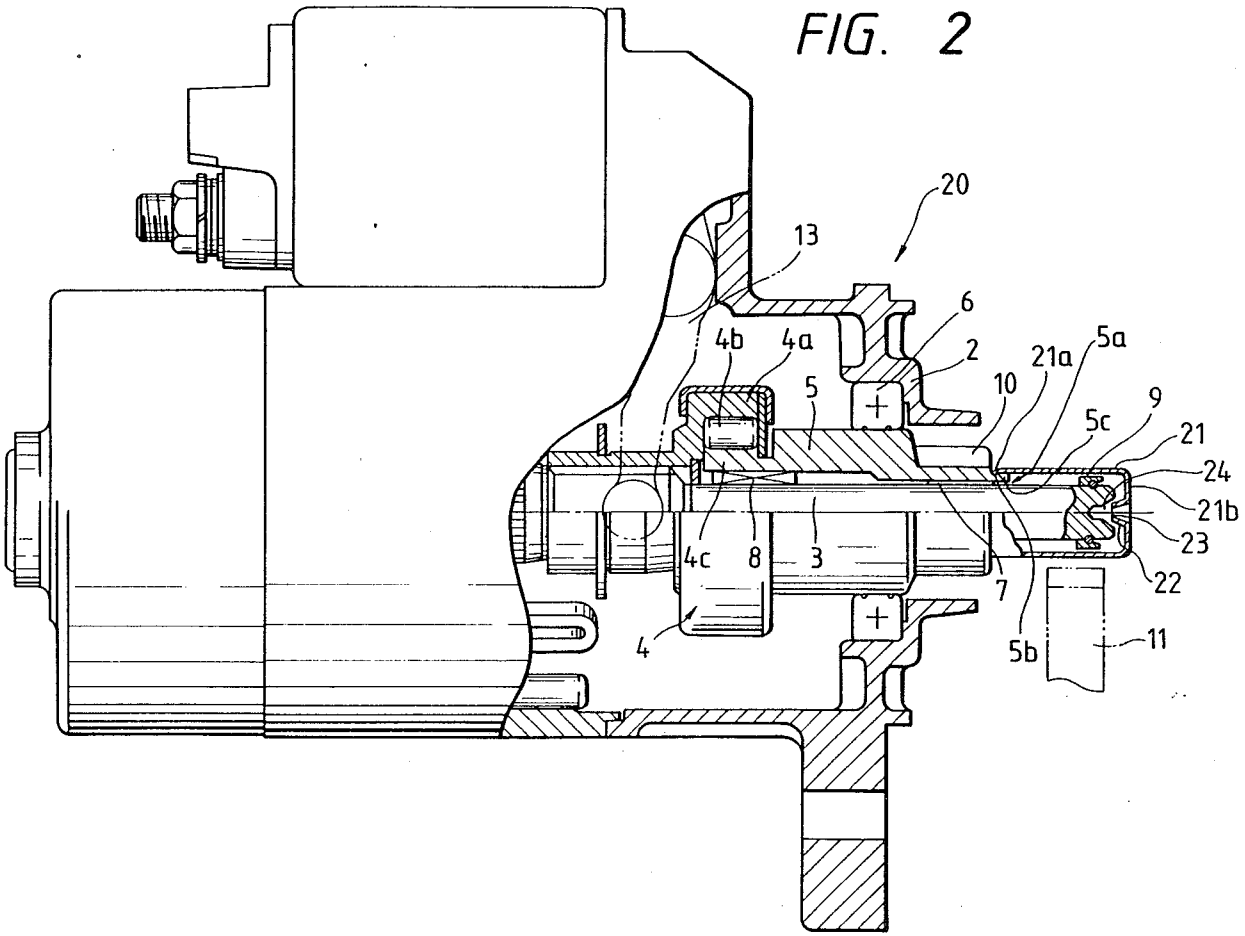
FIG. 2 is a front view, with parts cut away, showing a starter according to one embodiment of this invention.

FIG. 2 shows a starter 20 according to the invention. In FIG. 2, parts equal to or corresponding functional to those which have been previously described with reference to FIG. 1 showing the conventional starter 1 are therefore designated by the same reference numerals or characters.

The starter 20 has a bottomed cylindrical cap 21 connected to a cylinder 5*c* which is extended from the front end (or the right-handed end in FIG. 2) of the movable pinion cylinder 5. The cap 21 has an annular protrusion 21*a* forming the edge of its opening. The annular protrusion 21*a* of the cap 21 is press-fitted in an annular groove 5*b* formed in the outer cylindrical wall of the cylinder 5*c* in such a manner that the cap 21 covers the front end portion of the rotary output shaft 3.

A circular-truncated-cone-shaped protrusion 22 is extended inwardly from the center of the bottom of the cap 21; i.e., from the center of end face 21*b* of the cap 21. An air hole 23 is formed in the protrusion 22 in such a manner that it is extended along the central axis of the protrusion 22. On the other hand, a hole 24 is formed in the front end face of the rotary output shaft 3 at the center. More specifically, the hole 24 is so shaped as to receive the circular-truncated-cone-shaped protrusion 22 described above. When the movable pinion cylinder 5 is at the non-operating position where, as shown in FIG. 2, the pinion 10 is disengaged from the engine ring gear 11, the end portion of the protrusion 22 goes into the hole 24 formed in the front end face of the rotary output shaft 3. Therefore, when the movable pinion cylinder 5 is at the non-operating position, the entrance of dust into the cap 21 through the aid air hole 23 is prevented on the labyrinth effect.

When, in the starter thus constructed, the movable pinoin cylinder 5, together with the overrunning clutch 4, is slid forwardly on the rotary output shaft 3 in starting the engine, air is sucked into the cap 21 through the air hole 23. When the movable pinion cylinder 5 is returned to the original position, the air in the cap 21 is discharged through the air hole. As is apparent from the above description, when the movable pinion cylinder 5 is slid back and forth so that the front end portion of the rotary output shaft 3 is allowed to go in and out of the cap 21, the air pressure in the cap 21 is maintained unchanged, and therefore the cap 21 will never adversely affect the sliding operation of the movable pinion cylinder 5. As was described above, the circular-truncated-cone-shaped protrusion 22 of the cap 21 is allowed to go in the hole 24 formed in the front end face of the rotary output shaft 3. Therefore, although the cap 21 has the protrusion 22, it is unnecessary to make the length of the cap 21 longer than that of the conventional cap.

Figure 3:
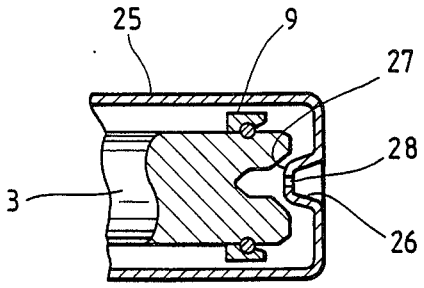
FIG. 3 is a sectional view showing a part of one modification of a cap coupled to the front end of a movable pinion cylinder in the starter.

FIG. 3 shows one modification of the cap 21. The cap 25 shown in FIG. 3 is different from the cap 21 in the configuration of the protrusion. The circular-truncated-cone-shaped protrusion 26 of the cap 26 has an end face at the top in which an air hole 28 is formed. The protrusion 26 thus formed can prevent the entrance of water more effectively than that of the cap 21 shown in FIG. 2. In the case of the cap 21 shown in FIG. 2, water may pass through the air hole 23 being guided by the inner cylindrical wall of the protrusion 22; whereas in the case of the cap 25 shown in FIG. 2, water guided by the inner cylindrical wall of the protrusion 26 is blocked by the end face in which the air hole 28 is formed; that is, the entrance of water into the cap can be more effectively prevented.

Another embodiment according to this invention will be described with reference to the accompanying drawings.

Figure 4:
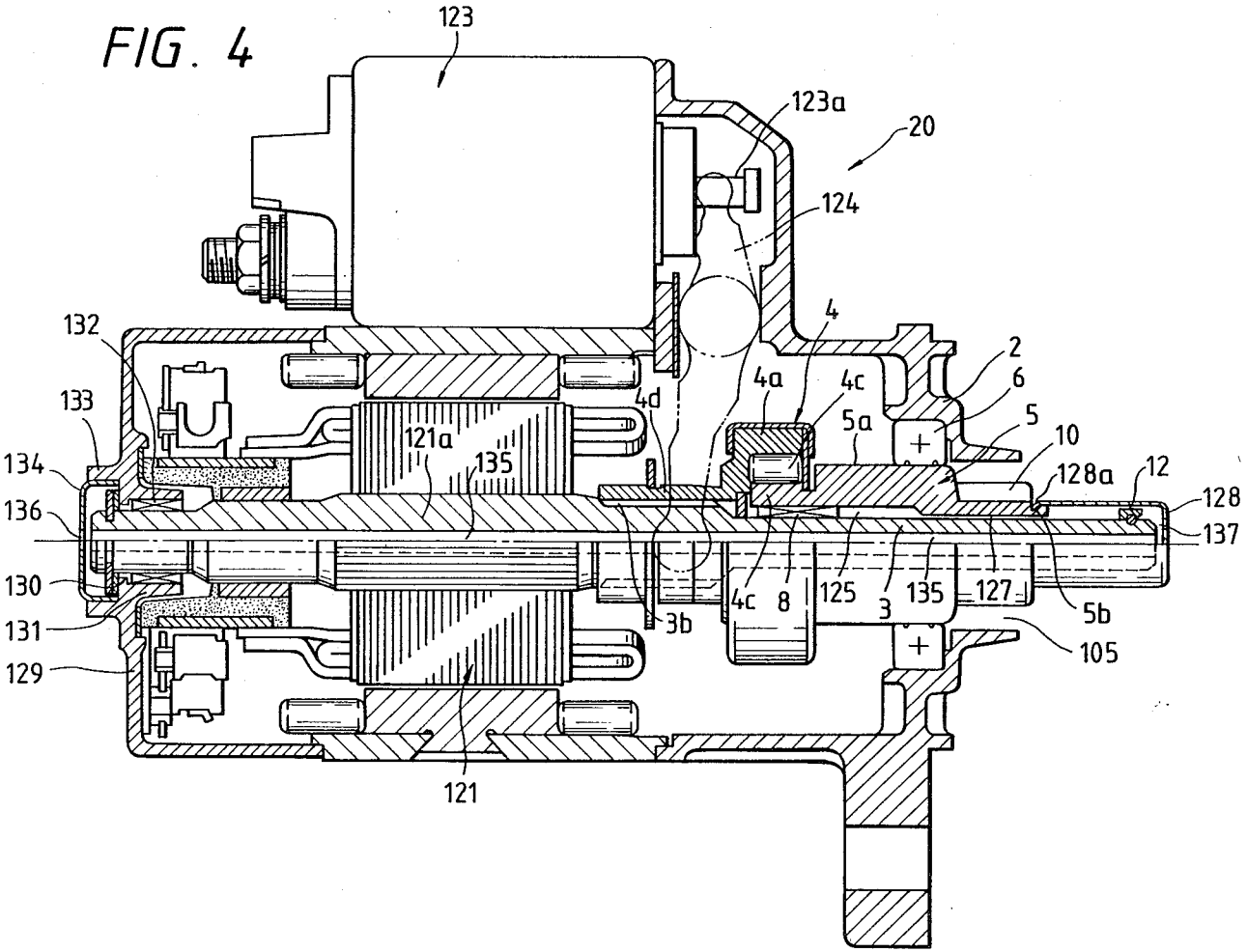
FIG. 4 is a sectional view showing starter according to another embodiment of this invention.

In FIG. 4, the starter 20 of the invention includes a DC motor 121. The rotary shaft 121*a* of the armature of the motor 121 has a rotary output shaft 3 extended forwardly which is the extension of the rotary shaft 121*a*. The rotary output shaft 3 is protruded from front frame 2 through an opening 105 formed therein. An overrunning clutch device 4 is mounted on the rotary output shaft 3 in such a manner that it is adjacent to the DC motor 121.

The overrunning clutch device 4 is a conventional one. A cylindrical part 4*d* integral with the clutch outer 4*a* is mounted on the rotary output shaft 3 in such a manner that it is slidable back and forth while engaging with the spline 3*b* of the rotary output shaft 3. The clutch inner 4*c* is the rear end portion of the movable pinion cylinder 5 which is slidably mounted on the rotary output shaft 3. Therefore, the cylindrical part 4*d*, the over-running clutch device 4, and the movable pinion cylinder are slid, as one unit, on the rotary output shaft 3. In this operation, a force in the axial direction is applied by a shift lever 124. One end portion of the shift lever 124 is engaged with the plunger rod 123*a* of an electromagnetic switch 123, and the other end portion thereof has two prongs which cross over the cylindrical part 4*d*.

As was described before, the rear end portion of the movable pinion cylinder 5 is formed into the clutch inner 4*c*. Therefore, for convenience in description, the rear end portion will be referred to as "a clutch inner part", when applicable. On the other hand, the front end portion of the pinion cylinder 5 is formed into a pinion part having a pinion 10 on the cylindrical wall. The middle part between the pinion part and the clutch inner part has a slidably supporting surface 5*a*. The slidably supporting surface 5*a* is inserted into the inner race of a ball bearing 6 which is fitted in the front frame 2 behind the opening 105 formed therein, so that the movable pinion cylinder 5 is slidably supported. The inner cylindrical wall of the part of the movable pinion cylinder 5, which is extended from the clutch inner part to the middle part (or the slidably supporting surface 5*a*), is relatively large in diameter, so that a relatively large gap 125 is formed between the inner cylindrical wall and the outer cylindrical wall of the output shaft 3. A bearing 8 is disposed in the gap 125 so that the movable pinion cylinder 5 is supported through the bearing 8 by the rotary output shaft 3. The bearing 8 is generally arranged in the rear end portion of the movable pinion cylinder 5; that is, it is arranged in the clutch inner part, and it is fixedly secured to the inner cylindrical wall, so that it together with the movable pinion cylinder 5 is slid on the rotary output shaft 3.

On the other hand, the inner cylindrical wall of the part of the movable pinion cylinder 5 which is extended from the pinion part to a part of the slidably supporting surface 5*a* is smaller in diameter than that of the remaining part, so that an extremely small clearance 127 is formed between the inner cylindrical wall and the outer cylindrical wall of the rotary output shaft 3.

A bottomed cylindrical cap 128 is connected to the front end of the movable pinion cylinder 5 in such a manner as to close the opening at the front end of the movable pinion cylinder 5. The length of the bottomed cylindrical cap 128 is such that the cap 128 covers the front end portion of the rotary output shaft 3 when the movable pinion cylinder 5 is returned to its rear position. The cap 128 has an annular protrusion 128*a* extended inwardly from the edge of the opening. The annular protrusion 128*a* is engaged with an annular groove 5*b* formed in the outer cylindrical wall of the front end portion of the movable pinion cylinder 5: that is, the cap 128 is detachably connected to the movable pinion cylinder 5. The cap 128 is formed by molding plastic. It is preferable that the plastic is Nylon 4.6.

On the other hand, the rear end portion of the armature rotary shaft 121*a* of the DC motor 121 is extended through an opening 130 formed in the rear frame 129 of the starter 20 in such a manner that it appears slightly outside the starter 20, and the rear end portion of the armature rotary shaft 121*a* thus extended is rotatably supported by a bearing 132 which is fitted in a cylindrical flange 131 which is extended inwardly from the periphery of the opening 130 of the rear frame 129. In addition, a cylindrical flange 133 is extended outwardly from the periphery of the opening 130. A metal cap 134 is press fitted in the flange 133 in such a manner as to cover the rear end portion of the armature rotary shaft 121*a*.

As is apparent from FIG. 4 and the above description, the armature rotary shaft 121*a* and the rotary output shaft 1 form one shaft. The one shaft will be referred to merely as "a rotary shaft" for convenience in description. A through-hole 135 is formed in the rotary shaft in such a manner that it is extended along the central axis of the rotary shaft and from the front end to the rear end. Furthermore, the cap 134 provided on the rear end face of the starter 20 has an opening 136 confronting the opening of the hole 135. Therefore, the space in the cap 128 connected to the front end of the pinion cylinder 5, especially the space 137 in front of the front end of the rotary output shaft 3 is communicated through the axial hole 135 in the rotary shaft with the outside air.

When, in the starting motor thus constructed, the movable pinoin cylinder 5 is moved forwardly to start the engine, the space 137 in the cap 128 is abruptly increased, so that the pressure in the cap 128 is going to decrease. However, since the space 137 in the cap 128 is communicated with the outside air through the axial hole 135 formed in the rotary shaft, the pressure in the cap 128 is not decreased, and therefore the movement of the movable pinion cylinder 5 is not affected. Furthermore, in this operation, the air behind the starter 20 is sucked into the cap 128 through the axial hole 135 formed in the rotary shaft. Since the air behind the starter 20 is clean because of the positional relationship of the starting motor with the engine, no dust will go into the cap 128. When, on the other hand, the movable pinion cylinder 5 is moved back to the original position, the air in the cap 128 is discharged through the axial hole 135, and therefore the pressure in the cap 128 is not increased. This is, the movable pinion cylinder 5 will be smoothly moved back to its original position.

In the above-mentioned embodiments according to the present invention, the bottomed cylindrical cap may be preferably made of a thin metal plate so that the inside diameter of the cap can be large. As a result, even when a sufficiently large gap is provided between the stopper and the inner cylindrical wall of the cap, the stopper may have a sufficiently high mechanical strength; that is, the durable of the starter is improved as much.

Figure 5:
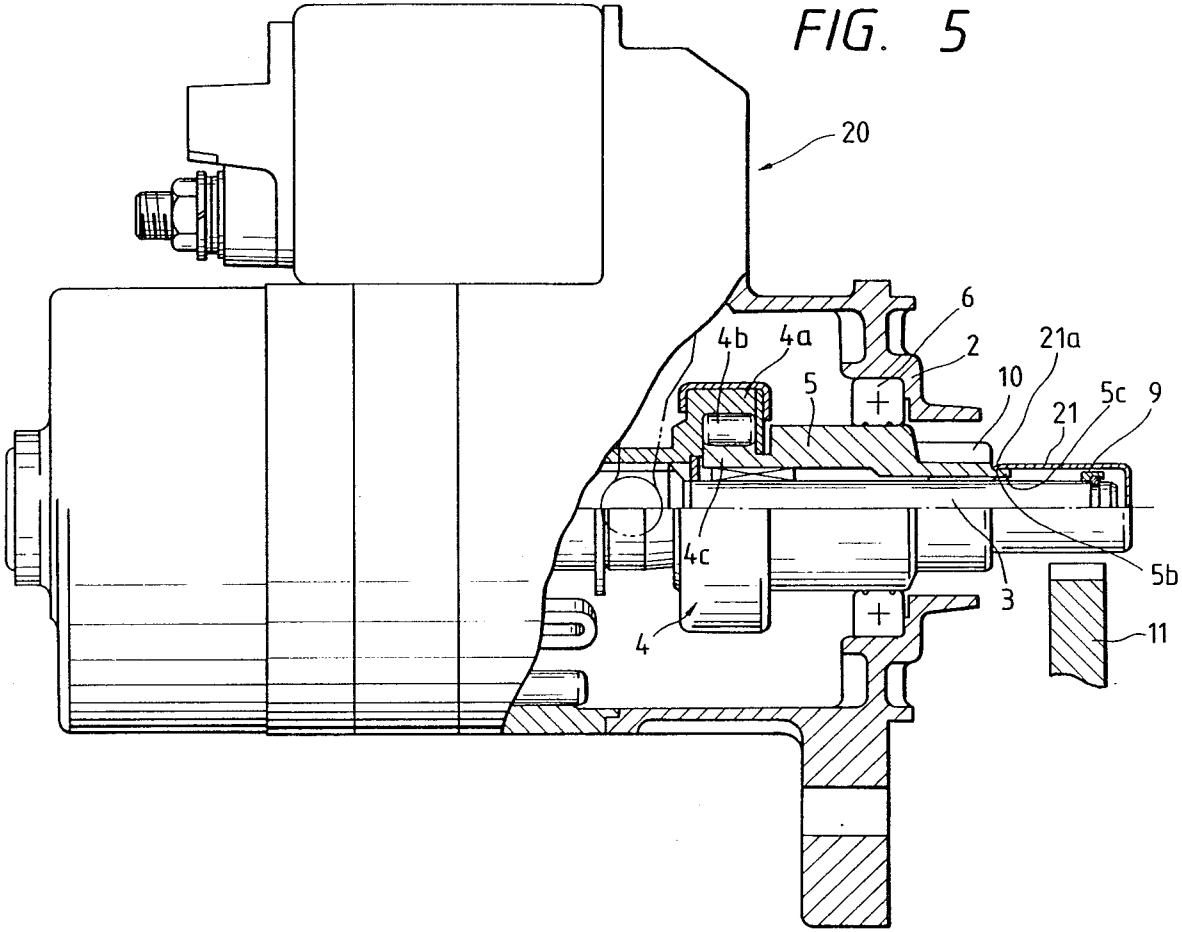
FIG. 5 is a sectional view showing a part of one example of a starter according to this invention.

For example, the starter 20 according to the invention, as shown in FIG. 5, has a movable pinion cylinder 5 which is slidably mounted on a rotary output shaft 3 in such a manner that it is slid on the rotary output shaft 3 a predetermined distance. The front end portion of the movable pinion cylinder 5 is formed in a pinion 10 which is engaged with an engine ring gear 11, and the rear end portion thereof is formed into a clutch inner 4*c* which is a part of an overrunning clutch 4. A cylinder 5*c* is extended axially from the front end face (the right-handed end face, in FIG. 5) of the movable pinion cylinder 5. An annular groove 5*b* is formed in the outer cylindrical wall of the cylinder 5*c*.

A dust protective bottomed cylindrical cap 21 is connected to the cylinder 5*c* in such a manner that the front end portion of the rotary output shaft 3 is inserted into the cap thereby to close the front end opening. More specifically, the cap 21 has an annular protrusion 21*a* forming the edge of its opening, and the annular protrusion 21*a* is press-fitted in the annular groove 5*b* formed in the cylinder. Thus, the cap 21 is positively secured to the cylinder 5*c*. The cap 21 is made of a thin steel plate. Therefore, even in the case where the outside diameter a of the cap 21 is substantially equal to the diameter of the root circle of the pinion 10, the inside diameter is larger than that of the conventional resin cap shown in FIG. 5. That is, the wall thickness $t_c'$ of the cap 21 (which may be as small as about 0.3 mm) is smaller than the wall thickness to of the conventional resin cap, and therefore the inside diameter is increased as much. Therefore, even when the gap between the outer cylindrical surface of the stopper 9 mounted on the front end portion of the rotary output shaft 3 and the inner cylindrical wall of the cap 21 is set to g similar as in the conventional starter, the wall thickness of the stopper 22 can be $t_s'$ larger than that of the conventional stopper. Therefore, the stopper 9 is free from the difficulty that it is insufficient in mechanical strength, as a result of which, when the movable pinion cylinder 5 strikes against the stopper repeatedly, so as to be stopped in position, the stopper is damaged.

Figure 6:
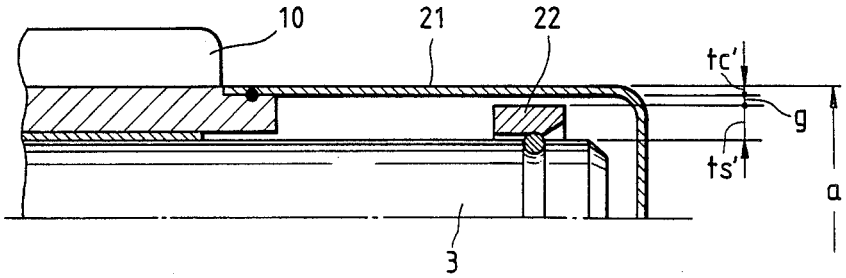
FIG. 6 is an enlarged sectional view showing a part of a cap in the starter shown in FIG. 5.
Figure 7:
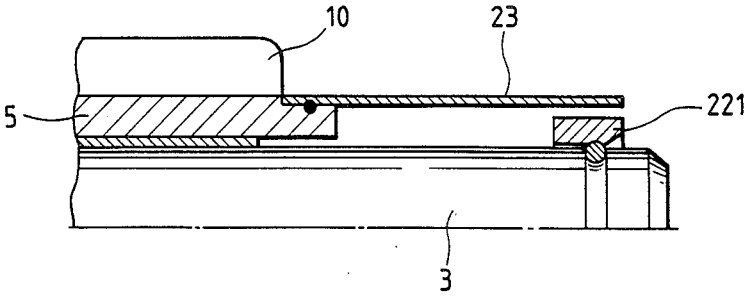
FIG. 7 is a sectional view showing a part of a cap in another example of the starter according to the invention.

The cap 21 may be welded to the cylinder 5*c* extended extended from the front end of the movable pinion cylinder 5 as shown in FIG. 6. That is, the cap 21 may be secured to the cylinder 5*c* at several points by spot welding or electron beam welding. In the above-described embodiment, the bottomed cap 21 is employed. However, it goes without saying that a cylinder 221 open at both ends as shown in FIG. 7 may be employed.

Thus, if the cap is made of a thin metal plate, the cap's inside diameter can be large. Therefore, the starter is free from the difficulty that the inner cylindrical wall of the cap rubs the stopper, thus damaging the stopper. In addition, the wall thickness of the stopper can be increased; that is, the stopper high in mechanical strength can be used.

As was described above, in the starter of the invention, the circular-truncated-cone-shaped protrusion having the air hole is extended from the bottom of the cap, and the hole for receiving the protrusion of the cap is formed in the front end face of the rotary output shaft. Therefore, when the movable pinion cylinder is slid, the air pressure in the cap can be maintained unchanged. Therefore, the movable pinion cylinder can be smoothly slid back and forth. In addition, the labyrinth effect of the circular-truncated-cone-shaped protrusion and the hole formed in the front end face of the rotary output shaft can prevent the entrance of dust.

Further, in the starter of the invention, the space in the dust protective cap connected to the front end of the movable pinion cylinder is communicated through the axial hole formed in the armature rotary shaft and the rotary output shaft integral with the armature rotary shaft with the outside air at the rear end of the starting motor. Therefore, the movable pinion cylinder can slide smoothly, and no dust is sucked into the cap when the movable pinion cylinder is moved forwardly.

What is claimed is:

1. A starter of overhang type for starting an engine, comprising:

an electric motor having an armature rotary shaft for providing torque to start the engine;

a rotary output shaft extended forwardly from said armature rotary shaft in the axial direction thereof;

an overrunning clutch device mounted on said rotary output shaft and having a clutch outer;

a movable pinion cylinder having a clutch inner at a rear end portion thereof, a pinion to engage with a ring gear of the engine at a front end portion thereof, and a slidably supporting surface at a middle portion thereof, said movable pinion cylinder being slidably mounted on said rotary output shaft, said overrunning clutch device detachably connecting said rotary output shaft to said movable pinion cylinder through said clutch inner to transmit a rotary force of said rotary output shaft to said movable pinion cylinder;

a front frame for supporting said rotary output shaft through said movable pinion cylinder;

a bearing fitted in said front frame and slidably supported by said slidably supporting surface;

a bottomed cylindrical cap connected to the front end portion of said movable pinion cylinder for cover the front end of said rotary output shaft; and inside pressure control means for controlling an inside pressure in said cap.

2. A starter as claimed in claim 1, wherein said inside pressure control means comprises a through-hole formed in said armature rotary shaft and said rotary output shaft integral with said armature rotary shaft to extend along the axial direction of said armature rotary shaft and said rotary output shaft from the front end thereof to the rear end thereof so that the inside of said cap is communicated through said through-hole with the atmosphere.

3. A starter as claimed in claim 1, wherein said inside pressure control means comprises a protrusion with an air hole extended from the center of the bottom of said cap toward the front end face of said rotary output shaft, said air hole being extended along the axial line of said protrusion.

4. A starter as claimed in claim 3, wherein the front end surface of said rotary output shaft is provided with a hole to receive said protrusion.

5. A starter as claimed in claim 4, wherein said protrusion is of a circular-truncated-cone shape.

6. A starter as claimed in claim 3, wherein said protrusion is provided with an end face at the top thereof in which said air hole is formed.

7. A starter as claimed in claim 2, wherein said cap is made of a thin metal plate.

8. A starter as claimed in claim 4, wherein said cap is made of a thin metal plate.

* * * * *